US011520261B2

(12) United States Patent
Kikuchi et al.

(10) Patent No.: US 11,520,261 B2
(45) Date of Patent: Dec. 6, 2022

(54) FIXING DEVICE, IMAGE FORMING APPARATUS, FIXING CONTROL METHOD

(71) Applicant: KYOCERA Document Solutions Inc., Osaka (JP)

(72) Inventors: Einosuke Kikuchi, Osaka (JP); Kuniaki Nakano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/648,378

(22) Filed: Jan. 19, 2022

(65) Prior Publication Data

US 2022/0236674 A1 Jul. 28, 2022

(30) Foreign Application Priority Data

Jan. 22, 2021 (JP) ..... JP2021-008457

(51) Int. Cl.
*G03G 15/20* (2006.01)
*G03G 15/02* (2006.01)
*G03G 15/00* (2006.01)

(52) U.S. Cl.
CPC ..... *G03G 15/2028* (2013.01); *G03G 15/0266* (2013.01); *G03G 15/2064* (2013.01); *G03G 15/5029* (2013.01); *G03G 2215/2025* (2013.01)

(58) Field of Classification Search
CPC ..... G03G 15/2066; G03G 15/2064; G03G 15/5029; G03G 2215/2025
See application file for complete search history.

(56) References Cited

U.S. PATENT DOCUMENTS 6,389,241 B1 * 5/2002 Cernusak ..... G03G 15/2003 399/45
2022/0236671 A1 * 7/2022 Kikuchi ..... G03G 15/20

FOREIGN PATENT DOCUMENTS

JP 2840483 B2 * 12/1988
JP 2000305388 A 11/2000
JP 2017090841 A * 5/2017 ..... G03G 15/2039

* cited by examiner

*Primary Examiner* — Sevan A Aydin
(74) *Attorney, Agent, or Firm* — Alleman Hall Creasman & Tuttle LLP

(57) ABSTRACT

A fixing device includes a fixing member, a pressurizing member, a charging portion, and a control portion. The fixing member rotates while being heated. The pressurizing member forms a nip portion between itself and a surface of the fixing member in such a way as to hold a sheet therebetween and conveys the sheet by rotating together with the fixing member, wherein an image of toner has been formed on the sheet. The charging portion electrically charges the surface of the fixing member to a polarity that is same as a charging polarity of the toner by supplying a charging current to a pair of electrodes that is disposed to face the surface of the fixing member. The control portion acquires sheet information that includes one or more of length information, width information, and thickness information of the sheet and adjusts the charging current based on the sheet information.

8 Claims, 3 Drawing Sheets

FIXING DEVICE, IMAGE FORMING APPARATUS, FIXING CONTROL METHOD

INCORPORATION BY REFERENCE

This application is based upon and claims the benefit of priority from the corresponding Japanese Patent Application No. 2021-008457 filed on Jan. 22, 2021, the entire contents of which are incorporated herein by reference.

BACKGROUND

The present disclosure relates to a fixing device, an image forming apparatus, and a fixing control method for preventing occurrence of an offset image by electrically charging a fixing member.

In an electrophotographic image forming apparatus, a fixing device fixes a toner image to a sheet by applying heat and pressure to the toner image formed on the sheet. The fixing device includes a heater, a fixing member, and a pressurizing member.

The fixing member rotates while being heated by the heater. The pressurizing member forms a nip portion between itself and the surface of the fixing member in such a way as to hold the sheet therebetween and conveys the sheet by rotating together with the fixing member.

In the fixing device, an offset image may be formed on the sheet when the fixing member is electrically charged to a polarity that is reverse to the charging polarity of the toner. The offset image is a noise image that is generated when a part of the toner on the sheet is electrically attracted to the surface of the fixing member and then transferred from the fixing member to the sheet.

On the other hand, the fixing device may include a charging portion that electrically charges, by electric discharge, the surface of the fixing member to a polarity that is the same as the charging polarity of the toner. By the action of the charging portion, the offset image is prevented from being formed.

SUMMARY

A fixing device according to an aspect of the present disclosure includes a fixing member, a pressurizing member, a charging portion, and a control portion. The fixing member rotates while being heated. The pressurizing member forms a nip portion between itself and a surface of the fixing member in such a way as to hold a sheet therebetween and conveys the sheet by rotating together with the fixing member, wherein an image of toner has been formed on the sheet. The charging portion electrically charges the surface of the fixing member to a polarity that is same as a charging polarity of the toner by supplying a charging current to a pair of electrodes that is disposed to face the surface of the fixing member. The control portion acquires sheet information that includes one or more of length information, width information, and thickness information, and adjusts the charging current based on the sheet information, the length information indicating a size of the sheet in a sheet conveyance direction, the width information indicating a size of the sheet in a width direction crossing the sheet conveyance direction, the thickness information indicating a thickness of the sheet.

An image forming apparatus according to another aspect of the present disclosure includes an image creating portion, a transfer portion, and the fixing device. The image creating portion creates the image of the toner. The transfer portion transfers the image of the toner to the sheet.

A fixing control method according to a further aspect of the present disclosure controls a fixing device that includes the fixing member, the pressurizing member, and the charging portion. The fixing control method includes a processor acquiring sheet information that includes one or more of length information, width information, and thickness information, the length information indicating a size of the sheet in a sheet conveyance direction, the width information indicating a size of the sheet in a width direction crossing the sheet conveyance direction, the thickness information indicating a thickness of the sheet. The fixing control method further includes the processor adjusting the charging current based on the sheet information.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

An image forming apparatus 10 according to an embodiment executes a print process to form an image on a sheet 9 by an electrophotographic method.

Figure 1:
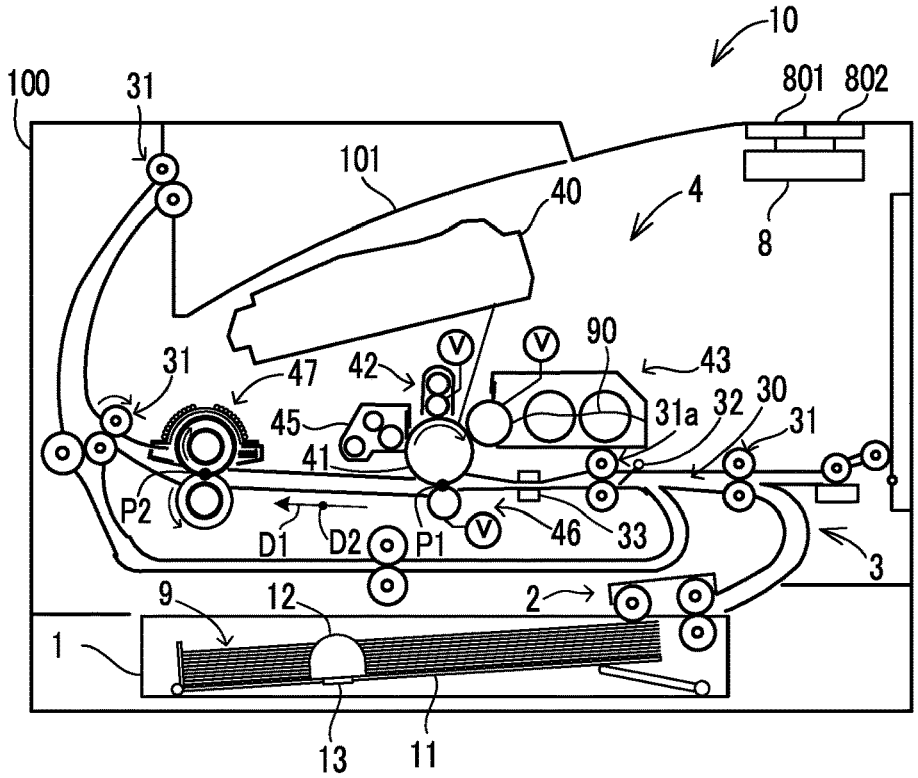
FIG. 1 is a configuration diagram of an image forming apparatus according to an embodiment.

As shown in FIG. 1, the image forming apparatus 10 includes a sheet storage portion 1, a sheet feed-out device 2, a sheet conveying device 3, an image creating device 4, a transfer device 46, a fixing device 47, a control device 8, an operation device 801, and a display device 802. The sheet storage portion 1, the sheet feed-out device 2, the sheet conveying device 3, the image creating device 4, the transfer device 46, the fixing device 47, and the control device 8 are stored in a main body portion 100 that is a housing.

In the following description, a direction in which the sheet 9 is conveyed, is referred to as a conveyance direction D1. In addition, a direction crossing the conveyance direction D1 is referred to as a width direction D2. The width direction D2 is perpendicular to the conveyance direction D1.

The sheet storage portion 1 includes a sheet mounting portion 11 and a pair of sheet cursors 12, wherein on the sheet mounting portion 11, sheets 9 that are to be conveyed to the transfer device 46 are mounted. The pair of sheet cursors 12 are provided at opposite sides of the sheets 9 mounted on the sheet mounting portion 11 in such a way as to move along the width direction D2.

Specifically, the pair of sheet cursors 12 are moved symmetrically along the width direction D2 by a rack and pinion mechanism (not shown).

The pair of sheet cursors 12 are placed along opposite ends of the sheets 9 in the width direction D2. This allows the sheets 9 to be positioned in the width direction D2 by the pair of sheet cursors 12.

The sheet feed-out device 2 feeds out the top-most one of a plurality of sheets 9 mounted on the sheet mounting portion 11 toward a conveyance path 30 provided in the main body portion 100.

The sheet conveying device 3 includes a plurality of pairs of conveyance rollers 31 and a resist sheet sensor 32. The plurality of pairs of conveyance rollers 31 is located in the conveyance path 30 in such a way as to convey a sheet 9 along the conveyance path 30 by rotating while holding the sheet 9 between rollers of each pair. The rear most pair of the plurality of pairs of conveyance rollers 31 discharges the sheet 9 from the conveyance path 30 to a discharge tray 101.

The plurality of pairs of conveyance rollers 31 includes a pair of resist rollers 31*a*. The pair of resist rollers 31*a* temporarily stops the sheet 9 that has been conveyed from a preceding pair of rollers 31, and then starts to convey the sheet 9 at a predetermined timing toward a transfer position P1 in the conveyance path 30.

The resist sheet sensor 32 detects the sheet 9 at a position upstream of the pair of resist rollers 31*a* in the conveyance direction D1 in the conveyance path 30.

The pair of resist rollers 31*a* is started after a predetermined time elapses since the resist sheet sensor 32 detects the sheet 9 in a state where the pair of resist rollers 31*a* is stopping. This adjusts the timing when the sheet 9 is conveyed toward the transfer position P1.

The image creating device 4 executes an image creating process to create an image of toner 90 on the surface of a photoconductor 41. The image creating device 4 is an example of an image creating portion. The photoconductor 41 is an example of an image carrier that carries the image of the toner 90.

The image creating device 4 includes, in addition to the photoconductor 41, a laser scanning unit 40, a drum charging device 42, a developing device 43, and a cleaning device 45.

In the image creating process, the drum-like photoconductor 41 rotates, and the drum charging device 42 electrically charges the surface of the photoconductor 41. Furthermore, the laser scanning unit 40 scans a laser beam on the electrically charged surface of the photoconductor 41, thereby writing an electrostatic latent image on the surface of the photoconductor 41.

By the action of the drum charging device 42 and the laser scanning unit 40, the electrostatic latent image that represents a print-target image, is formed on the surface of the photoconductor 41.

Furthermore, the developing device 43 develops the electrostatic latent image as the image of the toner 90 by supplying the toner 90 to the photoconductor 41 on which the electrostatic latent image has been formed. This forms the image of the toner 90 on the surface of the photoconductor 41. During the image creating process, the photoconductor 41 rotates while carrying the image of the toner 90.

At the transfer position P1 in the conveyance path 30, the transfer device 46 transfers the image of the toner 90 from the surface of the photoconductor 41 to the sheet 9. Furthermore, the transfer device 46 conveys the sheet 9, together with the photoconductor 41, toward a fixing position P2 in the conveyance path 30. The transfer device 46 is an example of a transfer portion.

At the fixing position P2, the fixing device 47 applies heat and pressure to the image of the toner 90 that has been transferred to the sheet 9. In this way, the fixing device 47 fixes the image of the toner 90 to the sheet 9.

Figure 2:
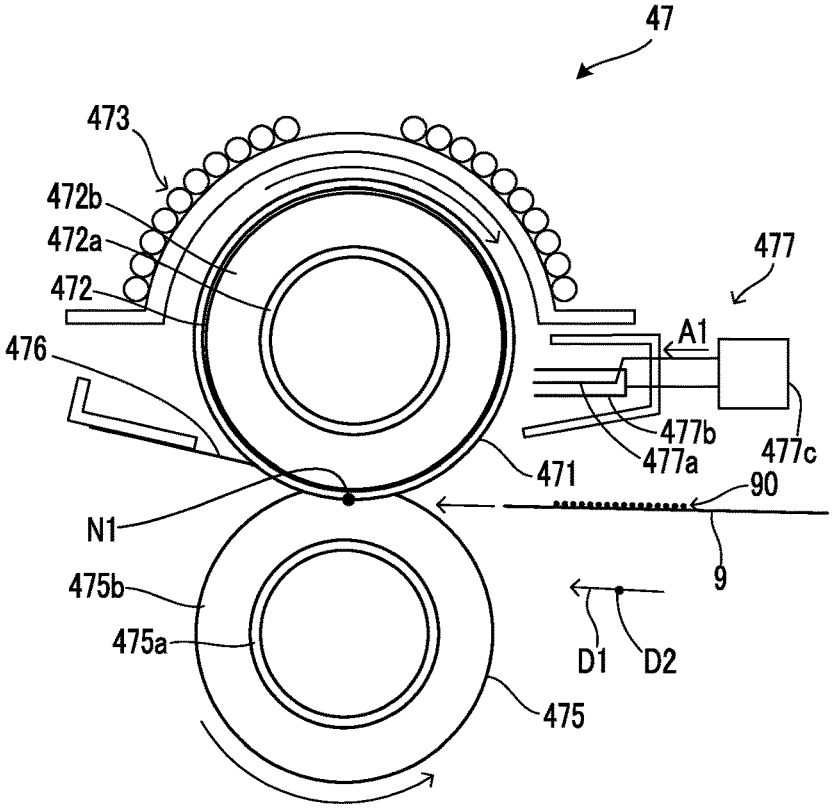
FIG. 2 is a configuration diagram of a fixing device included in the image forming apparatus according to the embodiment.

As shown in FIG. 2, the fixing device 47 includes a fixing belt 471, a fixing roller 472, a heater 473, a pressurizing roller 475, and a sheet separating member 476.

The fixing belt 471 is a flexible tubular member and includes the fixing roller 472 therein. The fixing belt 471 is heated by the heater 473.

The fixing roller 472 is a tubular member supporting the fixing belt 471 at its inside. The fixing roller 472 includes a tubular metal core portion 472*a* and an elastic portion 472*b* that is formed on the outer periphery of the metal core portion 472*a*. It is noted that the fixing roller 472 is an example of a support body that supports the fixing belt 471.

The fixing roller 472 is rotatably supported. The fixing belt 471 is configured to rotate together with the fixing roller 472.

In the present embodiment, the fixing belt 471 includes a conductive substrate, an elastic layer formed on the outer periphery of the substrate, and a release layer formed on the outer periphery of the elastic layer. In the fixing belt 471, the substrate is made of a metal mainly composed of nickel or the like, the elastic layer is made of silicon rubber, foamed resin or the like, and the release layer is made of resin such as polytetrafluoroethylene.

The heater 473 is disposed to face the outer peripheral surface of the fixing belt 471. In the present embodiment, the heater 473 is an electromagnetic induction heating type heating device. The heater 473 mainly heats the substrate of the fixing belt 471 by the electromagnetic induction.

The pressurizing roller 475 is rotatably supported and forms a nip portion N1 between itself and the surface of the fixing belt 471, wherein at the nip portion N1, the sheet 9 on which the image of the toner 90 has been formed is held between the pressurizing roller 475 and the fixing belt 471. The position of the nip portion N1 is the fixing position P2.

Similar to the fixing roller 472, the pressurizing roller 475 includes a tubular metal core portion 475*a* and an elastic portion 475*b* that is formed on the outer periphery of the metal core portion 475*a*. In addition, a release layer made of resin such as polytetrafluoroethylene is formed on the outer peripheral surface of the elastic portion 475*b*.

The metal core portion 472*a* of the fixing roller 472 and the metal core portion 475*a* of the pressurizing roller 475 are made of, for example, a metal mainly composed of aluminum or iron. In addition, the elastic portion 472*b* of the fixing roller 472 and the elastic portion 475*b* of the pressurizing roller 475 are made of silicon rubber, foamed resin or the like.

The pressurizing roller 475 is rotationally driven by a drive mechanism (not shown). The fixing belt 471 and the fixing roller 472 rotate in conjunction with the pressurizing roller 475. The pressurizing roller 475 conveys the sheet 9 by rotating together with the fixing belt 471.

The fixing belt 471 heats the image of the toner 90 formed on the sheet 9, and the pressurizing roller 475 pressurizes the image of the toner 90 toward the sheet 9. This allows the image of the toner 90 to be fixed to the sheet 9.

It is noted that the fixing belt 471 is an example of a fixing member that rotates while being heated. The fixing roller 472 is an example of a support member that is disposed inside the fixing belt 471. The pressurizing roller 475 is an example of a pressurizing member.

The fixing device 47 further includes a fixing charging device 477. The fixing charging device 477 includes a charging probe 477*a*, a shield member 477*b*, and a current output circuit 477*c*.

The charging probe 477*a* and the shield member 477*b* are conductive members disposed to face the surface of the fixing belt 471. The current output circuit 477*c* causes a charging current A1 to flow by applying a voltage to the charging probe 477*a* and the shield member 477*b*.

The charging probe 477*a* and the shield member 477*b* are disposed at a small interval. The charging current A1 is caused to flow between the charging probe 477*a* and the shield member 477*b* by electric discharge.

The fixing charging device 477 electrically charges the surface of the fixing belt 471 to a polarity that is the same as the charging polarity of the toner 90 by supplying the charging current A1 to the charging probe 477*a* and the shield member 477*b*. In the present embodiment, the charging polarity of the toner 90 is positive. The charging probe 477*a* and the shield member 477*b* are an example of a pair of electrodes. The fixing charging device 477 is an example of a charging portion.

The fixing charging device 477 is configured to prevent an offset image from being formed on the sheet 9 when the fixing belt 471 is charged to a polarity that is reverse to the charging polarity of the toner 90.

The operation device 801 is configured to receive human operations, and, for example, includes operation buttons and a touch panel. The display device 802 is configured to display information, and, for example, is a panel display device such as a liquid crystal display panel.

Figure 3:
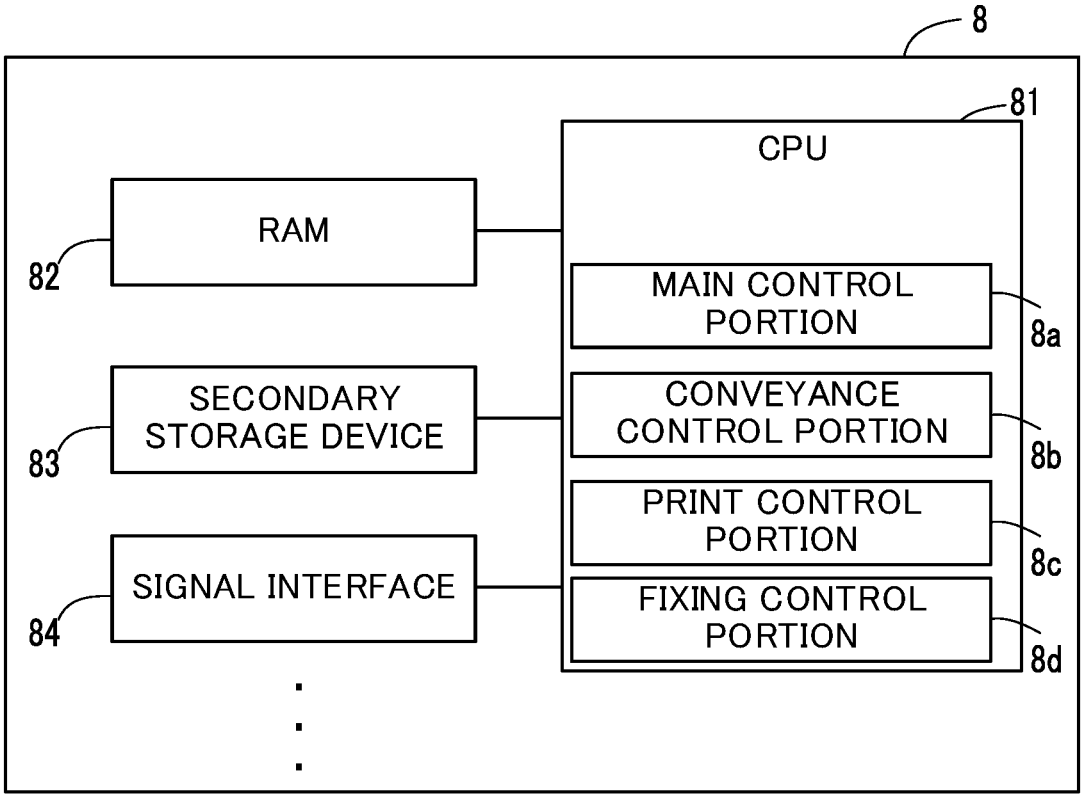
FIG. 3 is a block diagram showing a configuration of a control device included in the image forming apparatus according to the embodiment.

As shown in FIG. 3, the control device 8 includes a CPU (Central Processing Unit) 81 and peripheral devices such as a RAM (Random Access Memory) 82, a secondary storage device 83, and a signal interface 84.

The CPU 81 is a processor that executes various types of data processing and controls by executing computer programs. The RAM 82 is a computer-readable volatile storage device. The RAM 82 temporarily stores the computer programs executed by the CPU 81, and data that is output and consulted by the CPU 81 during execution of the various types of processing.

The CPU 81 includes a plurality of processing modules that is realized when the computer programs are executed. The plurality of processing modules includes a main control portion 8*a*, a conveyance control portion 8*b*, a print control portion 8*c*, and a fixing control portion 8*d*.

The main control portion 8*a* executes a control to start any one of the various types of processing in accordance with an operation performed on the operation device 801, and executes a control of the display device 802.

The conveyance control portion 8*b* controls the sheet feed-out device 2 and the sheet conveying device 3. When a print process is executed, the conveyance control portion 8*b* causes the plurality of pairs of conveyance rollers 31 to operate and causes the sheet feed-out device 2 to operate for a predetermined time period. This allows the top-most sheet 9 on the sheet mounting portion 11 to be fed toward the conveyance path 30 and conveyed toward the pair of resist rollers 31*a*.

Furthermore, the conveyance control portion 8*b* temporarily stops the pair of resist rollers 31*a* at a timing that is determined based on a time point when the sheet 9 is detected by the resist sheet sensor 32, and then restarts the pair of resist rollers 31*a*.

The print control portion 8*c* causes the image creating device 4 to create an image of the toner 90 in synchronization with the conveyance of the sheet 9 by the sheet conveying device 3.

The fixing control portion 8*d* controls the heater 473 and the fixing charging device 477 of the fixing device 47. The fixing control portion 8*d* constitutes a part of the fixing device 47.

Specifically, the fixing control portion 8*d* controls power of the heater 473 so that a temperature detected by a fixing temperature sensor (not shown) becomes a predetermined target temperature. The fixing temperature sensor is configured to detect the temperature of the fixing belt 471.

Furthermore, the fixing control portion 8*d* causes the current output circuit 477*c* to output the charging current A1 each time the sheet 9 passes the fixing position P2.

The secondary storage device 83 is a computer-readable nonvolatile storage device. The secondary storage device 83 is configured to store and update the computer programs and various types of data. For example, either or both of a flash memory and a hard disk drive are adopted as the secondary storage device 83.

The signal interface 84 is configured to convert signals output from various types of sensors such as the resist sheet sensor 32 to digital data, and transmit the digital data to the CPU 81. Furthermore, the signal interface 84 is configured to convert a control command output from the CPU 81 to a control signal and transmit the control signal to a control-target device.

Meanwhile, it is known that, in the fixing device 47, a volatile component is released due to the heat generated by the heater 473. In addition, it has been confirmed that the amount of the volatile component is increased due to the electric discharge performed by the fixing charging device 477.

An effective way to suppress generation of the volatile component is to suppress a discharged charge amount of the fixing charging device 477, namely, to minimize the charging current A1 output from the fixing charging device 477 as small as possible. On the other hand, when the charging current A1 is excessively small, the fixing charging device 477 fails to sufficiently charge the surface of the fixing charging device 477, thereby causing the offset image to occur.

In the present embodiment, the fixing control portion 8*d* executes a charging current control to suppress an amount of released volatile component while preventing occurrence of the offset image. The charging current control is described below.

Here, a relationship among the charging current A1, the size of the sheet 9, and a belt surface potential V1 is described with reference to FIG. 4 and FIG. 5. The belt surface potential V1 is the surface potential of the fixing belt 471.

Figure 4:
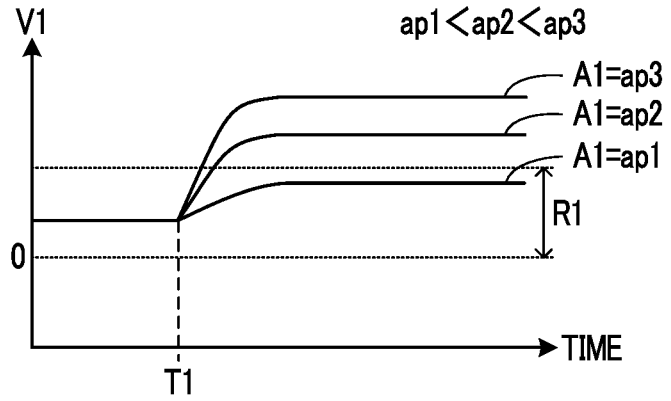
FIG. 4 is a diagram showing a result of an experiment on how a surface potential of a fixing belt changes when a charging current is output in the fixing device.

The graph of FIG. 4 shows a result of an experiment on how the belt surface potential V1 changes when the charging current A1 is output in the fixing device 47. In FIG. 4, T1 represents a charging start time point T1 that is a time point when a predetermined charging current A1 starts to flow in the fixing device 47 in operation.

Figure 5:
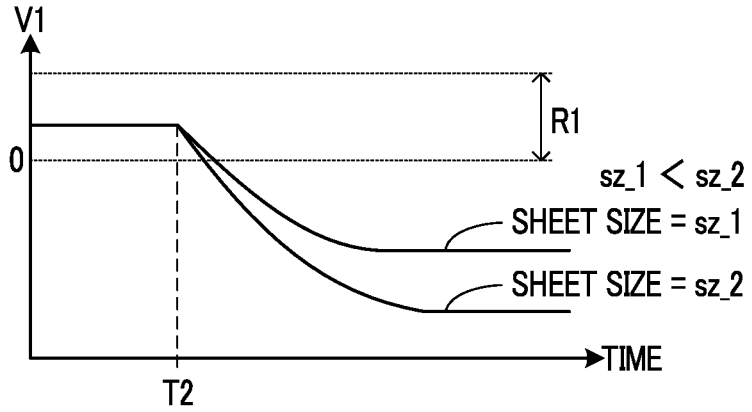
FIG. 5 is a diagram showing a result of an experiment on how the surface potential of the fixing belt changes when a sheet passes through the fixing device.

The graph of FIG. 5 shows a result of an experiment on how the belt surface potential V1 changes when the sheet 9 passes through the fixing device 47. In FIG. 5, T2 represents a sheet reach time point T2 that is a time point when a tip of the sheet 9 reaches the nip portion N1 of the fixing device 47 when the charging current A1 is not flowing.

In FIG. 4 and FIG. 5, R1 represents a target potential range R1 that is a target range of the belt surface potential V1 required to suppress the amount of released volatile component while preventing occurrence of the offset image.

The graph of FIG. 4 shows that, as the charging current A1 becomes larger, the rising speed of the belt surface potential V1 becomes higher, and the belt surface potential V1 becomes higher. This indicates that when the charging current A1 is excessively large, the belt surface potential V1 exceeds the target potential range R1, and the amount of released volatile component increases.

The graph of FIG. 5 shows that, as the size of the sheet 9 becomes larger, the falling speed of the belt surface potential V1 becomes higher, and the belt surface potential V1 becomes lower. It is thought that a difference in the size of the sheet 9 corresponds to a difference in the electrostatic capacitance of the sheet 9. As the electrostatic capacitance of the sheet 9 becomes larger, the speed and amount of the charge moving between the fixing belt 471 and the sheet 9 becomes larger.

Accordingly, in a case where the charging current A1 is set in correspondence with a small-size sheet 9, when a large-size sheet 9 passes through the nip portion N1, the belt surface potential V1 may fall below the target potential range R1, and the offset image may be formed.

On the other hand, in a case where the charging current A1 is set in correspondence with the large-size sheet 9, when the small-size sheet 9 passes through the nip portion N1, the belt surface potential V1 may exceed the target potential range R1, and the amount of released volatile component may increase.

In view of the above, in the charging current control, the fixing control portion 8*d* acquires sheet information that includes one or more of length information, width information, and thickness information of the sheet 9 that is being conveyed toward the nip portion N1.

The length information indicates the size of the sheet 9 in the conveyance direction D1. The width information indicates the size of the sheet 9 in the width direction D2. The thickness information indicates the thickness of the sheet 9.

Furthermore, in the charging current control, the fixing control portion 8*d* adjusts the charging current Al based on the sheet information by controlling the current output circuit 477*c*. The charging current control executed by the fixing control portion 8*d* is an example of a fixing control method.

Specifically, the fixing control portion 8*d* adjusts the charging current A1 to be larger when the size of the sheet 9 indicated by the sheet information is large than when the size of the sheet 9 indicated by the sheet information is small.

For example, a look-up table may be set preliminarily, wherein the look-up table indicates a plurality of candidates which are each a combination of a size range of the sheet 9 and the charging current A1. In this case, the fixing control portion 8*d* identifies a size range corresponding to the acquired sheet information and controls the current output circuit 477*c* so as to cause the charging current A1 corresponding to the identified size range to flow.

For example, the size range is a range of the size indicated by the length information, the width information, or the thickness information. In addition, the size range may be a range of the area of the sheet 9 that is derived from the length information and the width information. In addition, the size range may be a range of the volume of the sheet 9 that is derived from the length information, the width information, and the thickness information.

In the present embodiment, the fixing control portion 8*d* acquires a detection result of the resist sheet sensor 32. Furthermore, the fixing control portion 8*d* identifies, as the length information, a time period for which the sheet 9 is detected by the resist sheet sensor 32 while the pair of resist rollers 31*a* are rotating.

It is noted that the resist sheet sensor 32 is an example of a sheet sensor that detects the sheet 9 at a position upstream of the fixing device 47 in the conveyance direction D1 in the conveyance path of the sheet 9.

In addition, the image forming apparatus 10 includes a potentiometer 13 that measures the position of the pair of sheet cursors 12 (see FIG. 1). The potentiometer 13 measures the size of the sheet 9 in the width direction D2 by measuring the position of the pair of sheet cursors 12.

The fixing control portion 8*d* acquires the measurement result of the potentiometer 13 as the width information. It is noted that the potentiometer 13 is an example of a width measuring portion that measures the size of the sheet 9 in the width direction D2 by measuring the position of the pair of sheet cursors 12.

Furthermore, the image forming apparatus 10 includes a thickness sensor 33 that measures the thickness of the sheet 9 (see FIG. 1). For example, the thickness sensor 33 is an electrostatic capacitance sensor disposed at a position upstream of the fixing device 47 in the conveyance direction D1 in the conveyance path 30.

The fixing control portion 8*d* acquires the measurement result of the thickness sensor 33 as the thickness information. It is noted that the thickness sensor 33 is an example of a thickness measuring portion.

One or more of the length information, the width information, and the thickness information of the sheet 9 may be input via the operation device 801. In this case, the fixing control portion 8*d* acquires a part or all of the sheet information via the operation device 801.

With the adoption of the image forming apparatus 10, it is possible to suppress the amount of released volatile component while preventing occurrence of the offset image.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a fixing member configured to rotate while being heated;

a pressurizing member that forms a nip portion between itself and a surface of the fixing member in such a way as to hold a sheet therebetween and conveys the sheet by rotating together with the fixing member, wherein an image of toner has been formed on the sheet;

a charging portion configured to electrically charge the surface of the fixing member to a polarity that is same as a charging polarity of the toner by supplying a charging current to a pair of electrodes that is disposed to face the surface of the fixing member; and a control portion configured to acquire sheet information that includes one or more of length information, width information, and thickness information, and adjust the charging current based on the sheet information, the length information indicating a size of the sheet in a sheet conveyance direction, the width information indicating a size of the sheet in a width direction crossing the sheet conveyance direction, the thickness information indicating a thickness of the sheet.

2. The fixing device according to claim 1, wherein the fixing member is a flexible tubular member and is supported by a support member that is disposed inside the fixing member.

3. An image forming apparatus comprising:

an image creating portion configured to create the image of the toner;

a transfer portion configured to transfer the image of the toner to the sheet; and the fixing device according to claim 1.

4. The image forming apparatus according to claim 3, further comprising:

a sheet sensor configured to detect the sheet at a position upstream of the fixing device in the sheet conveyance direction in a conveyance path of the sheet, wherein the control portion acquires a detection result of the sheet sensor, and identifies, as the length information, a time period for which the sheet is detected by the sheet sensor.

5. The image forming apparatus according to claim 3, further comprising:

a width measuring portion configured to measure a size of the sheet in the width direction, wherein the control portion acquires a measurement result of the width measuring portion as the width information.

6. The image forming apparatus according to claim 5, further comprising:

a pair of sheet cursors provided at opposite sides of the sheet mounted on a sheet mounting portion in such a way as to move along the width direction, the pair of sheet cursors being placed along opposite ends of the sheet in the width direction, wherein the width measuring portion measures the size of the sheet in the width direction by measuring a position of the pair of sheet cursors.

7. The image forming apparatus according to claim 3, further comprising:

a thickness measuring portion configured to measure a thickness of the sheet, wherein the control portion acquires a measurement result of the thickness measuring portion as the thickness information.

8. A fixing control method for controlling a fixing device that includes:

a fixing member configured to rotate while being heated;

a pressurizing member that forms a nip portion between itself and a surface of the fixing member in such a way as to hold a sheet therebetween and conveys the sheet by rotating together with the fixing member, wherein an image of toner has been formed on the sheet; and a charging portion configured to electrically charge the surface of the fixing member to a polarity that is same as a charging polarity of the toner by supplying a charging current to a pair of electrodes that is disposed to face the surface of the fixing member, the fixing control method comprising:

a processor acquiring sheet information that includes one or more of length information, width information, and thickness information, the length information indicating a size of the sheet in a sheet conveyance direction, the width information indicating a size of the sheet in a width direction crossing the sheet conveyance direction, the thickness information indicating a thickness of the sheet; and the processor adjusting the charging current based on the sheet information.

* * * * *